US010556766B2

(12) United States Patent
Stahelin

(10) Patent No.: US 10,556,766 B2
(45) Date of Patent: Feb. 11, 2020

(54) APPLIED CONSTRUCTIVE HEAD LAYOUT FOR STRUCTURAL GLAZING SYSTEM

(71) Applicant: VTECH Comércio de Esquadrias e Vidros Ltda. EPP, São Pedro de Alcantara (BR)

(72) Inventor: Marcelo Stahelin, Sao Pedro de Alcantara (BR)

(73) Assignee: TAS EQUIPAMENTOS EIRELI, Sao Pedro de Alcantara (BR)

( * ) Notice: Subject to any disclaimer, the term of this patent is extended or adjusted under 35 U.S.C. 154(b) by 107 days.

(21) Appl. No.: 15/485,407

(22) Filed: Apr. 12, 2017

(65) Prior Publication Data

US 2017/0297851 A1 Oct. 19, 2017

(51) Int. Cl.

| | |
|---|---|
| ***B65H 23/032*** | (2006.01) |
| ***B65H 20/02*** | (2006.01) |
| ***B65H 35/04*** | (2006.01) |
| *E06B 3/56* | (2006.01) |

(52) U.S. Cl.

CPC ..... *B65H 23/032* (2013.01); *B65H 20/02* (2013.01); *B65H 35/04* (2013.01); *E06B 3/56* (2013.01)

(58) Field of Classification Search

CPC ..... B65H 20/02; B65H 23/032; B65H 35/06; B65H 35/0013

See application file for complete search history.

(56) References Cited

U.S. PATENT DOCUMENTS 7,849,903 B2 * 12/2010 Vaniglia ..... B29C 70/384 156/252
9,481,158 B2 * 11/2016 Horst ..... B29C 70/384
9,993,981 B2 * 6/2018 Johnson ..... B26D 7/0683

* cited by examiner

*Primary Examiner* — Mark A Osele
*Assistant Examiner* — Christopher C Caillouet
(74) *Attorney, Agent, or Firm* — Bay State IP, LLC

(57) ABSTRACT

Refers to the present invention, a device (1) that will be fabricated with appropriate material, with several dimensions, to be adapted to a computerized numeric platform, for the structural glazing process, which is a technique of fixing the glass and the frame, through application of the high adhesion double-sided tape between them, the structure remains hidden on the inner side, in two basic steps, one being application and cutting of the high adhesion double-sided tape over the glass sheet, and the other is (applying) correct pressure on them, for the purpose of replacing the current manual process.

3 Claims, 4 Drawing Sheets

APPLIED CONSTRUCTIVE HEAD LAYOUT FOR STRUCTURAL GLAZING SYSTEM

BACKGROUND OF THE INVENTION

Referring to the current invention, a device that will be fabricated with appropriate material, with several dimensions, to be adapted to a computerized numeric platform, for the structural glazing process, which is a technique of fixing the glass and the frame, through application and cutting of the high adhesion double-sided tape between them, the structure remains hidden on the inner side, using this technique, whenever we take a look at the frame from the outer side we only see the glass and from the inner side we are able to see only the frame and glass No similar device has been found in the feasibility research that was conducted in the field of application, that had the same or similar concepts and functioning compared to the device presented in question.

The device presented here, has the purpose of replacing the manual process that is currently used, eliminating human effort, labor, saving time and raw material, reduced energy consumption, technically modernizing this process with safety and quality, gradually increasing the productivity

BRIEF SUMMARY OF THE INVENTION

The device operates in two basic steps, the application of the high adhesion double-sided tape over the glass sheet and the cutting of the tape with the specific numeric coordinate x, y and z at the computerized numeric platform, where the device accurately applies tape to the glass thus automatically applying and trimming it, the other step is applying the correct pressure on them which is determined by the tape manufacturer, also determined by the numeric coordinates x, y and z, over the frame and the glass, running through all its perimeter, providing the adequate fusion between frame, tape and glass.

Hereafter, the current device which comprises of an upper part, a lower part, and an inner part which is constituted by the following parts: centralizing flange washer (2); Cylinder fixing base (3); bronze bushing of the main neck of the head (4); cylinder body (5); core shaft of the head (6); cylinder shaft (7); upper polypropylene roller shaft 34 (8); lower polypropylene roller shaft 35 (9); rubber roller shaft 33 (10); smooth traction roller shaft 38 (11); traction roller shaft 37 (12); tape stand shaft (13); step motor gear (14); gear of the smooth traction roller shaft 38 (15); gear of the rubber traction roller shaft 33 and the smooth traction roller shaft 38 (16); air gripper 1 (17); air gripper 2 (18); centralizing flange of the tape roll (19); tape guide 1 (20); tape guide 2 (21); tape guide 3 (22); cutting blade of the cylinder shaft tip (23); side 1 (24); side 2 (25); step motor (26); main neck of the head (27); limiting pin of the tape guide 3 (28); air system part 1 (29); air system part 2 (30); air system part 3 (31); side bearing 1 and 2 (32); rubber roller (33); upper polypropylene roller (34); lower polypropylene roller (35); roll guide (36); traction roller (37); smooth traction roller (38); tape stand 1 side 1 (39); tape stand 1 side 2 (40); lower pipe bracket of the core shaft of the head (41); upper pipe bracket 1 of the core shaft of the head (42); step motor stand 1 (43); step motor stand 2 (44); cylinder lid (45); step motor protection lid (46); transmission for the conveyor belt with 49 teeth (47) and will be described in complete details, in accordance with the attached images where:

DETAILED DESCRIPTION OF THE INVENTION

Figure 1:
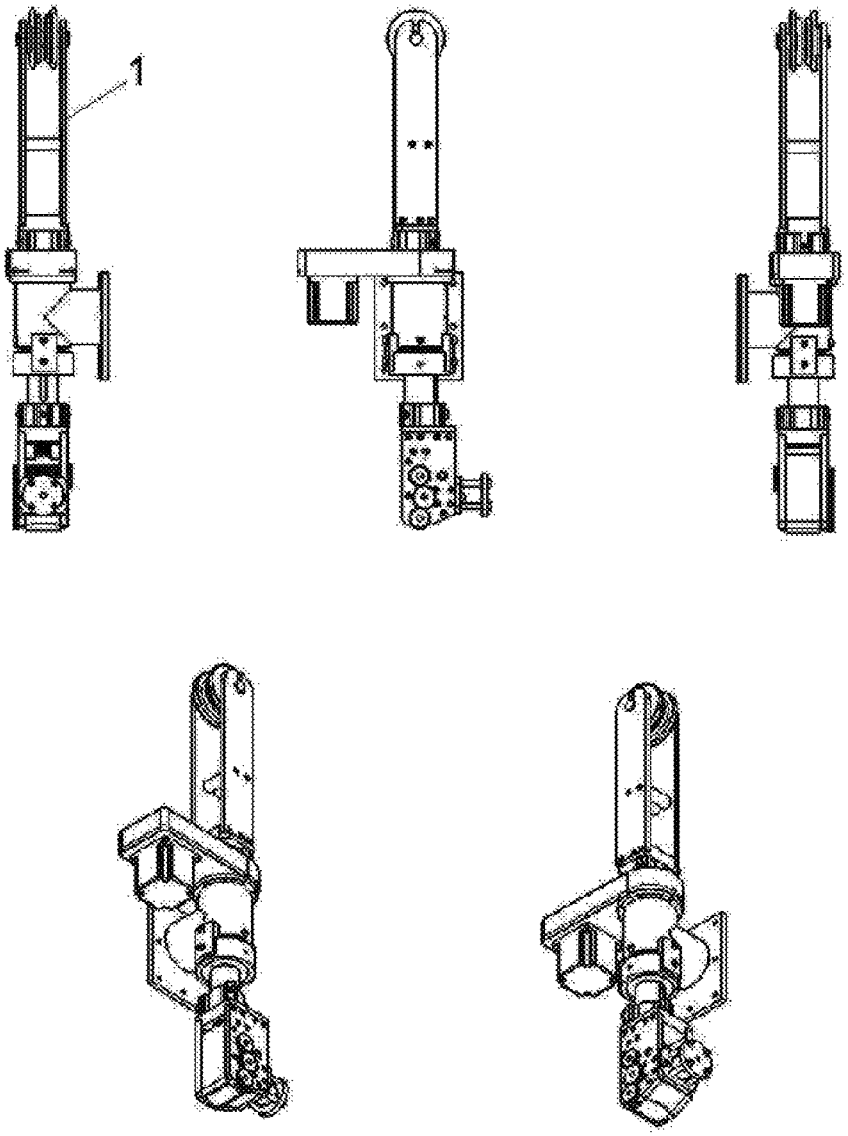
FIG. 1 shows all views of the mentioned device (1) assembled, showing all its sides.
Figure 2:
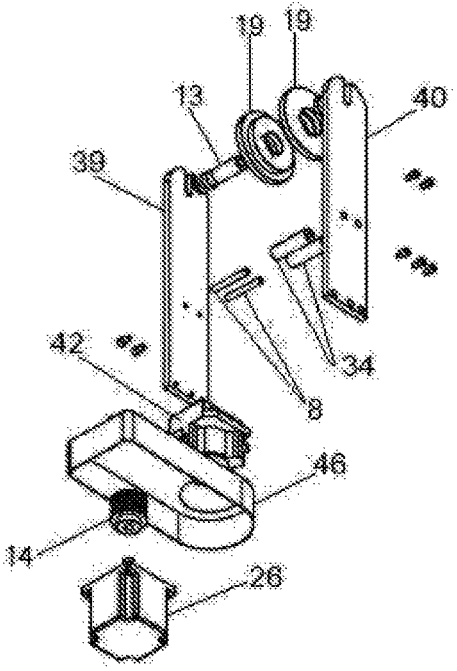
FIG. 2 shows a perspective exploded view of the upper part of the said device (1), showing its following parts: upper polypropylene roller shaft 34 (8); tape roll holder shaft (13); step moto gear (14); centralizing flange of the tape roll (19); step motor (26); upper polypropylene roller (34); tape stand 1 side 1 (39); tape stand 1 side 2 (40); upper pipe bracket 1 of the core shaft of the head (42); step motor protection lid (46).
Figure 3:
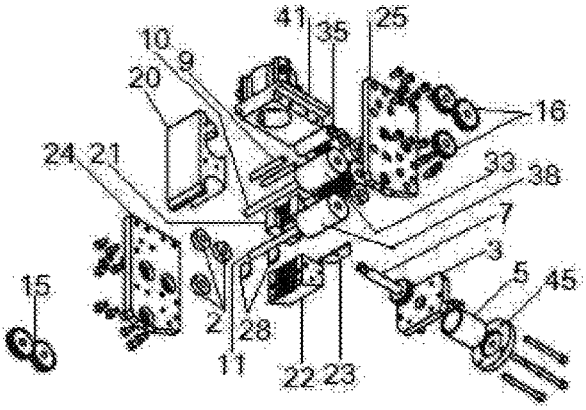
FIG. 3 shows an exploded perspective view of the lower part of the said device (1), with its following parts: centralizing flange washer (2); cylinder shaft 35 (9); rubber shaft 33 (10); a smooth traction roller shaft 38 (11); gear of the smooth traction roller shaft 38 (15); gear of the rubber traction roller shaft 33 and smooth traction roller gear 38 (16); tape guide 1 (20); tape guide 2 (21); tape guide 3 (22); cutting blade of the cylinder shaft tip (23); side 1 (24); side 2 (25); limiting pin of the tape guide 3 (28); rubber roller (33); lower polypropylene roller (35); smooth traction roller (38); lower pipe bracket of the core shaft of the head (41); cylinder lid (45).
Figure 4:
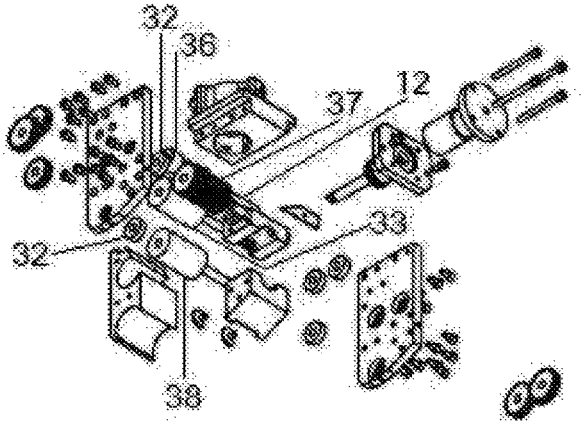
FIG. 4 shows a continuation of the exploded perspective view of the lower part of the said device (1), with its following parts: traction roller shaft 37 (12); side bearing 1 and 2 (32); rubber roller (33); roll guide (36); traction roller (37); smooth traction roller (38)
Figure 5:
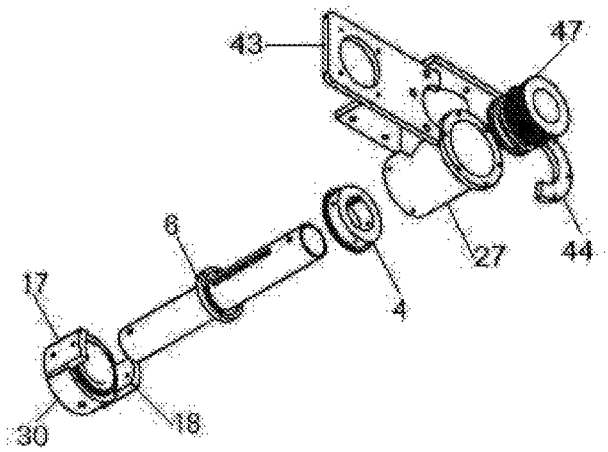
FIG. 5 shows an exploded perspective view of the inner part of the said device (1), with its following parts: bronze bushing of the main neck of the head (4); core shaft of the head (6); air gripper 1 (17); air gripper 2 (18); main neck of the head (27); air system part 2 (30); step motor stand 1 (43); step motor stand 2 (44); transmission for the conveyor belt with 49 teeth (47)
Figure 6:
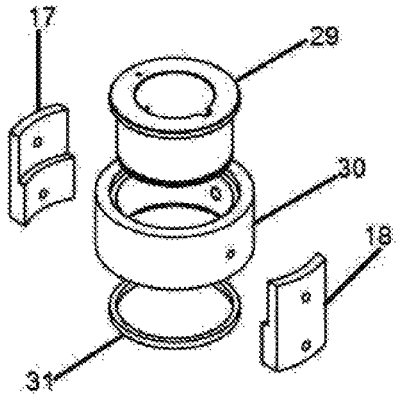
FIG. 6 shows a continuation of the exploded perspective view of the inner part of the said device (1), with its following parts: air gripper 1 (17); air gripper 2 (18); air system part 1 (29); air system part 2 (30); air system part 3 (31).

Image 1 shows all views of the mentioned device (1) assembled, showing all its sides;

Image 2 shows a perspective exploded view of the upper part of the said device (1), showing its following parts: upper polypropylene roller shaft 34 (8); tape roll holder shaft (13); step motor gear (14); centralizing flange of the tape roll (19); step motor (26); upper polypropylene roller (34); tape stand 1 side 1 (39); tape stand 1 side 2 (40); upper pipe bracket 1 of the core shaft of the head (42); step motor protection lid (46).

Image 3 shows an exploded perspective view of the lower part of the said device (1), with its following parts: centralizing flange washer (2); cylinder fixing base (3); cylinder body (5); cylinder shaft (7); lower polypropylene roller shaft 35 (9); rubber roller shaft 33 (10); smooth traction roller shaft 38 (11); gear of the smooth traction roller shaft 38 (15); gear of the rubber traction roller shaft 33 and smooth traction roller gear 38 (16); tape guide 1 (20); tape guide 2 (21); tape guide 3 (22); cutting blade of the cylinder shaft tip (23); side 1 (24); side 2 (25); limiting pin of the tape guide 3 (28); rubber roller (33); lower polypropylene roller (35); smooth traction roller (38); lower pipe bracket of the core shaft of the head (41); cylinder lid (45).

Image 4 shows a continuation of the exploded perspective view of the lower part of the said device (1), with its following parts: traction roller shaft 37 (12); side bearing 1 and 2 (32); rubber roller (33); roll guide (36); traction roller (37); smooth traction roller (38);

Image 5 shows an exploded perspective view of the inner part of the said device (1), with its following parts: bronze bushing of the main neck of the head (4); core shaft of the head (6); air gripper 1 (17); air gripper 2 (18); main neck of the head (27); air system part 2 (30); step motor stand 1 (43); step motor stand 2 (44); transmission for the conveyor belt with 49 teeth (47);

Image 6 shows a continuation of the exploded perspective view of the inner part of the said device (1), with its following parts: air gripper 1 (17); air gripper 2 (18); air system part 1 (29); air system part 2 (30); air system part 3 (31).

The operation of the first stage of the device (1), this invention object, is started every time by the operator, using the numeric command, with x, y and z coordinates, inserted on the computerized platform, inserts the high adhesion double-sized tape between the tape roller of the centralizing flanges (19), position the rubber roller (33) leaning against a surface, it is, then automatically pushed and mechanically moves through the traction roller gears (37) and (38) pulling the adhesive tape that is going to be fixed, which is determined by the operator himself, then the pneumatic cylinder (5) cuts the tape, using the cutting blade of the cylinder shaft tip (23) and the rubber roller (33) is then pushed further to position the tape for the next one to be fixed, then the entire device lifts up and is ready to be positioned again and start the whole process.

The operation of the second stage of the device (1), this invention object, is started every time by the operator, using the numeric command with x, y and z coordinates inserted in the computerized platform, this time without the high adhesion tape, the said device (1) will press both parts that have been bonded by the tape, fixing them permanently, running only through the specific path determined by the coordinates Based on researches done, we described and illustrated the device (1) and we conclude that it has technical, constructive and functional features of originality and novelty, which are not found in the technical industry, fitting in the criteria that define an Invention Patent, therefore being a new practical and efficient solution for the structural glazing process.

The invention claimed is:

1. A system for configured for use with an applied constructive head layout for structural glazing comprising:

an inner part comprising:
- a core shaft of a head;
- a main neck of the head;
- a bronze brushing of the main neck of the head;
- a first air system;
- a second air system;
  - wherein the first air system in inserted into the second air system such that the first air system is surrounded by the second air system;
- a third air system;
  - wherein the third air system is arranged on a bottom of the second air system;
- at least two air grippers wherein the air grippers are arranged opposite one another on the second air system;
- a first step motor stand located on one side of a transmission for a conveyor belt with teeth;
- a second motor stand on the opposite side of the transmission for a conveyor belt with teeth from the first step motor stand;

an upper part comprising:
- a tape stand comprising;
  - a first side; and
  - a second side;
  - wherein the first side is positioned opposite the second side;
- at least one upper polypropylene roller shaft arranged between the first side and second side of the tape stand;
- at least one upper polypropylene roller arranged on the at least one upper polypropylene roller shaft;
- a tape roll holder shaft arranged between the first side and the second side of the tape stand;
- a step motor gear;
- a step motor located below the step motor gear;
- a step motor protection lid arranged above the step motor gear;
- at least one centralizing flange of the tape roll;
- an upper pipe bracket of the core shaft of the head located above the step motor protection lid; and a lower part comprising:
- at least one centralizing flange washer;
- a cylindrical fixing base;
- a cylindrical body;
- a cylindrical shaft;
- at least one lower propylene roller shaft;
- at least one lower propylene roller arranged on the at least one lower propylene roller shaft;
- a rubber roller shaft;
- a rubber roller arranged on the rubber roller shaft;
- a smooth traction roller shaft;
- a smooth traction roller shaft arranged on the smooth traction roller shaft;
- at least one gear of the smooth traction roller shaft;
- at least one gear of the rubber traction rolling shaft and smooth traction roller gear;
- a first tape guide;
- a second tape guide;
- a third tape guide;
- a cutting blade of a cylinder shaft tip;
- a first side of the lower portion;
- a second side of the lower portion wherein the second side is positioned opposite the first side;
- at least one limiting pin of the tape guide;
- a traction roller shaft;
- a traction roller arranged on the traction roller shaft;
- at least two side bearings;
- a rubber roller;
- a roll guide;
- a lower pipe bracket of a core shaft of a head; and
- a cylinder lid.

2. A method for fusion and glazing using the system configured for use with the applied constructive head layout for structural glazing according to claim 1 comprising the steps of:

entering a numeric command into a computerized platform with coordinates x,y and z;

inserting a high adhesion double-sided tape between the tape roller of the centralizing flanges positioning the rubber roller such that it is leaning against a surface;

pushing automatically and mechanically moving through the traction roller gears;

pulling the adhesive tape that is going to be fixed as determined by an operator cutting the tape using cutting blade of the cylinder shaft tip of the pneumatic cylindrical body;

pushing the rubber roller to position the tape for the next adhesive tape that is going to be fixed; and lifting the device in preparation for repositioning and starting the process again.

3. A method for fusion and glazing according to claim 2, further comprising the steps of:

removing the high adhesion tape;

inserting numeric commands with coordinates x,y and z;

pressing parts together which have been bonded by the high adhesive tape to permanently fix the parts together running only through the specific path determined by the coordinates.

* * * * *